United States Patent [19]

Ruhl

[11] Patent Number: 5,033,518

[45] Date of Patent: Jul. 23, 1991

[54] FINE ADJUSTMENT FOR FILLING MACHINE HAVING PISTON DIFFERENTIAL PRESSURE

[75] Inventor: Mark A. Ruhl, Baltimore, Md.

[73] Assignee: National Instrument Company, Inc., Baltimore, Md.

[21] Appl. No.: 495,094

[22] Filed: Mar. 19, 1990

[51] Int. Cl.[5] ..... B65B 3/04

[52] U.S. Cl. ..... 141/84; 141/266; 222/309; 222/267; 92/13.7; 92/13.8

[58] Field of Search ..... 222/309, 282, 283, 267; 92/13.3, 13.4, 13.5, 13.51, 13.8, 117 A, 13.7; 141/84, 266

[56] References Cited

U.S. PATENT DOCUMENTS

| | | | |
|---|---|---|---|
| 2,345,693 | 4/1944 | Wilson et al. | 92/13.8 |
| 2,807,213 | 9/1957 | Rosen | 222/180 X |
| 2,814,310 | 11/1957 | Lower | 92/13.5 |
| 3,122,280 | 2/1964 | Goda | 222/309 |
| 3,206,072 | 9/1965 | Mencken | 92/134 |
| 3,923,205 | 12/1975 | Ohlin | 222/309 |
| 4,187,890 | 2/1978 | Stach et al. | 222/309 X |
| 4,212,416 | 7/1980 | Bennett | 222/267 |
| 4,425,986 | 1/1984 | Weldin | 222/309 X |

*Primary Examiner*—Henry J. Recla
*Assistant Examiner*—Casey Jacyna
*Attorney, Agent, or Firm*—Barnes & Thornburg

[57] ABSTRACT

A filling machine wherein a lost motion mechanism is provided with a counteracting element to counteract forces between the driver and the filling unit to assure that the lost motion mechanism operates with lost motion. The counteracting element is provided between the lost motion mechanism and the driver and is operable during the suction stroke and inoperable during the discharge stroke.

18 Claims, 3 Drawing Sheets

FINE ADJUSTMENT FOR FILLING MACHINE HAVING PISTON DIFFERENTIAL PRESSURE

BACKGROUND AND SUMMARY OF THE INVENTION

The present invention relates to a high-speed filling machine for filling one or several containers with a predetermined amount of a product, and more particularly to an adjusting mechanism for varying the amount to be dispensed by any type of filling unit into the container connected with the filling unit.

Filling machines of the type to which the present invention relates are known as such in the prior art (U.S. Pat. Nos. 2,807,213 and 2,907,614). In these prior art filling machines, the filling units consisting of a cylinder and piston reciprocating within the cylinder driven by an eccentric drive arrangement. The eccentric pin was operatively connected with the free end of the piston rod such as to allow for a change in the pump stroke and therewith the amount of the product to be dispensed by a given filling unit. For this purpose, the prior art eccentric drives included an adjusting mechanism to vary the amount of eccentricity between the eccentric drive pin and the axis of rotation of the disc-like driving member carrying the drive pin by the use of a lead screw assembly, as more fully disclosed in the aforementioned U.S. Pat. Nos. 2,807,213 and 2,907,614.

While this arrangement proved satisfactory in actual operation for many years, it nevertheless entailed a number of disadvantages. First of all, since the prior art adjusting mechanism for changing the volume of the pump stroke was part of and connected with the rotating disc-like member, any adjustment in the volume of the product to be discharged into the container or containers required a stoppage of the entire filling machine. This drawback became ever more significant as the requirement to improve the overall efficiency of the filling machines became increasingly important, i.e., as the need to increase the speed and to reduce any downtime of the filling machine became ever more important. Moreover, the prior art volume-adjusting mechanisms were relatively complicated in structure thereby increasing the cost of the machine. Additionally, since the adjusting mechanism involved moving parts, subjected to rotation while the machine was operating, the parts of the adjusting mechanism had to be constructed correspondingly strong to be able to withstand the occurring stresses. As a solution to these problems, U.S. Pat. No. 4,227,627 provides the adjustable lost motion; volume adjusting mechanism at the part of the filling unit normally connected with a relatively fixed part of the filling machine.

Finally, when more than one filling unit was operated from a given eccentric drive as disclosed, for example, in the U.S. Pat. No. 4,077,441, the prior art adjusting mechanisms did not permit individual trimming adjustments of the individual filling units to compensate for minor operating differences therebetween. As a solution to this problem, U.S. Pat. No. 4,212,416 provides individually adjustable, lost motion mechanism between a common drive bar and individual filling units.

Although U.S. Pat. Nos. 4,212,416 and 4,227,627 operate efficiently in a variety of applications, there are other applications in which they do not work. To be more specific, when there is a differential pressure across the piston, the lost motion mechanism becomes inoperative. For example, when the liquid to the filling unit is under greater than atmospheric pressure, during the suction or intake stroke, this causes substantial, constant pressure on the product side of the piston which in turn overcomes the frictional drag of the filling unit seals. This effectively locks the lost motion portion, for example, in U.S. Pat. No. 4,212,416 in its lower position with the top of slot 32 engaging the bearing member 33. This is the normal position of the slot and bearing for the discharge stroke of the lost motion mechanism not the suction or intake stroke. Thus, the lost motion mechanism is ineffective. The same problem occurs with the lost motion mechanism of U.S. Pat. No. 4,227,627.

A similar condition occurs in the filling unit as shown in U.S. Pat. 4,569,378, wherein a vacuum is employed to the bottom side of a piston assembly to guarantee the operational integrity of the diaphragm-type seals. This vacuum creates a force on the underside of the piston rather than a positive feed pressure on the upper product side of the piston, but in effect produces the same results of nullifying the lost motion mechanism.

Thus, it is an object of the invention to provide a volume adjusting mechanism including a lost motion which is operable with any kind of filling unit.

Another object of the present invention is to provide a volume adjusting mechanism which can be used with filling units wherein the nonproduct side of the piston is under vacuum.

Still a further object of the present invention is to provide a volume adjusting mechanism including lost motion which can be used with filling units wherein the liquid supply to the filling unit is fed at greater than atmospheric pressure.

These and other objects are attained by providing a counteracting mechanism for acting on a lost motion mechanism of a filling machine to counteract forces between the reciprocal driver and the filling unit to assure that the lost motion mechanism operates with lost motion. The counteracting mechanism is provided between the lost motion mechanism and the driver and is operable during the intake stroke and inoperable during the discharge stroke. The counteracting mechanism includes an actuator acting directly on the lost motion mechanism or through a spring.

The lost motion mechanism includes a first element having an elongated slot and a second element which varies the length of the elongated slot. A third element connected to the driver slides within the elongated slot. The adjustable second element includes a shaft extending from the first element to the driver and the biasing element is mounted around the shaft between the first element and the driver. The shaft is threaded into the first element and extends through the driver. The driver may be a linear reciprocal driver or an eccentric reciprocal driver. Where the filling machine includes a plurality of filling units, each is connected to a common driver by an individual adjustable lost motion mechanism and counteracting mechanism. By the adjustable second element descending beyond the driver, it is readily adjustable during operation.

Other objects, advantages and novel features of the present invention will become apparent from the following detailed description of the invention when considered in conjunction with the accompanying drawings.

DETAILED DESCRIPTION OF THE DRAWINGS

Figure 1:
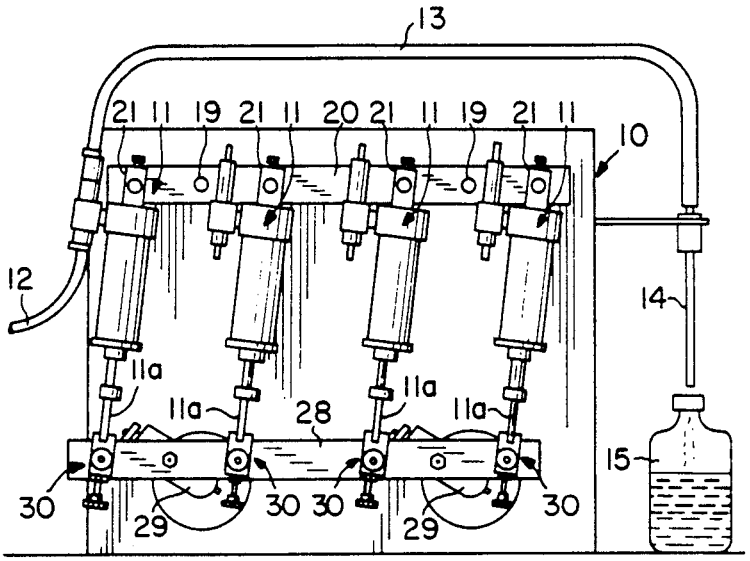
FIG. 1 PRIOR ART
FIG. 1 is a filling machine with plural filling units according to prior art U.S. Pat. No. 4,212,416.

Referring now to the drawings wherein like reference numbers are used throughout the various views, FIG. 1 illustrates a conventional four-pump filling machine generally designated by reference numeral 10 as disclosed in the aforementioned U.S. Pat. No. 4,212,416. Four individual filling units 11 each have a piston rod 11*a* and a connecting member 11*b* (FIG. 2) threadably connected to the lower end of the piston rod and provided with a transverse bore. Each filling unit 11 of the filling machine 10 includes an intake line 12 from a supply tank (not shown) and a discharge line 13 leading to a discharge or filling nozzle 14. The nozzle 14 is adapted to reciprocate for lowering into the container 15 prior to the discharge stroke and for raising upon completion of the discharge stroke to permit the container to move away from the filling station, as described more fully, for example, in the prior U.S. Pat. Nos. 3,067,768 and 3,237,661. Since the filling machine, as such, is of conventional construction, only those parts are illustrated herein which are believed necessary for an understanding of the present invention. Moreover, the number of individual filling units 11 may, of course, also vary from installation to installation.

Each filling unit 11 is pivotally connected at its upper end on an upper mounting bar 20 by an upper swivel assembly generally designated by reference numeral 21. The upper mounting bar 20 is fastened onto the pre-existing mounting pins 19 associated with the pre-existing individual eccentric drives used for individually driving a filling unit, as more fully described in the aforementioned U.S. Pat. No. 4,077,441. The upper swivel assembly 21 may include an adjustable lost motion mechanism of U.S. Pat. No. 4,227,627.

A common drive bar 28 is operatively connected with two eccentric drive members 29 each provided with a volume control as disclosed in the U.S. Pat. No. 2,807,213 to permit overall adjustment of the discharge stroke of all filling units. The lower end 11*b* of the piston rod 11*a* is connected with the drive bar 28 by a lower swivel assembly generally designated by reference numeral 30 equipped with a fine adjusting lost motion mechanism, for example, in accordance with U.S. Pat. No. 4,212,416.

Although the improvement of the present invention over that of U.S. Pat. Nos. 4,227,627 and 4,212,416 is described in detail in FIGS. 2 through 4 with a linear reciprocal drive, the present invention is also applicable to the eccentric drive of FIG. 1. Similarly, the lost motion mechanism will be described with a connection 30 between the driver and the filling unit 11 as in U.S. Pat. No. 4,212,416, it may also be used at the connection of the filling unit to the filling machine at the upper mounting part 21 as in U.S. Pat. No. 4,227,627 and other lost motion connections may be used.

Figure 2:
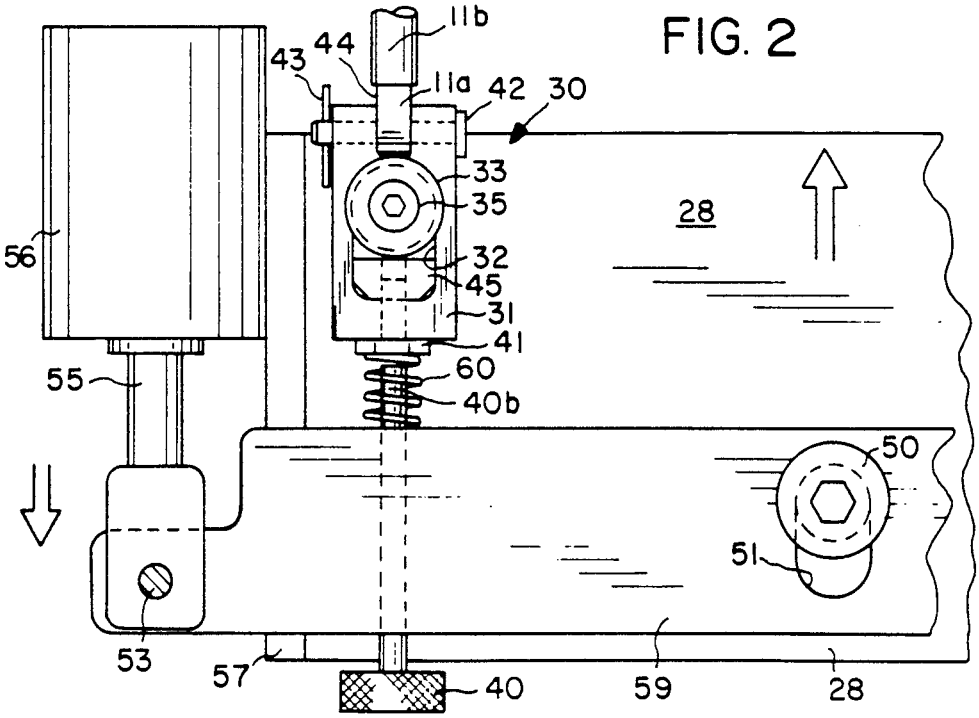
FIG. 2 is a partial view of the connection between a driver and a filling unit according to the principles of the present invention at the end of its discharge stroke.

Referring to FIGS. 2 and through 4, the lower swivel assembly 30 includes a lower swivel member 31 of substantially rectangular configuration and provided with an elongated slot 32 extending therethrough. A circularly shaped bearing member 33 has a diameter slightly less than the narrow dimension of the slot 32 and includes a circularly shaped shoulder portion. The bearing member 33 is provided with an internal bore 34 receiving the enlarged smooth bearing section 36 of a shoulder screw 35 having a threaded end section 37 by which it is threadably received in aperture 28*b* of the common drive bar 28 by interposition of a washer 38. The bearing member 33 slides in slot 32 to produce the lost motion interconnection between the driver and the filling unit.

The lower end of the swivel member 31 is provided with a threaded through-bore 39 extending in the direction of the large dimension of the elongated slot 32 to receive therein the threaded end 40*b* of a fine adjusting screw 40 which depending on its adjustment projects more or less deeply into the space defined by the elongated slot 32. A lock nut 41 is provided to hold the fine adjusting screw 40 in place. A stop 45 is counterbored to receive the thread end 40*b* and moves in slot 32 to define its length.

Figure 5:
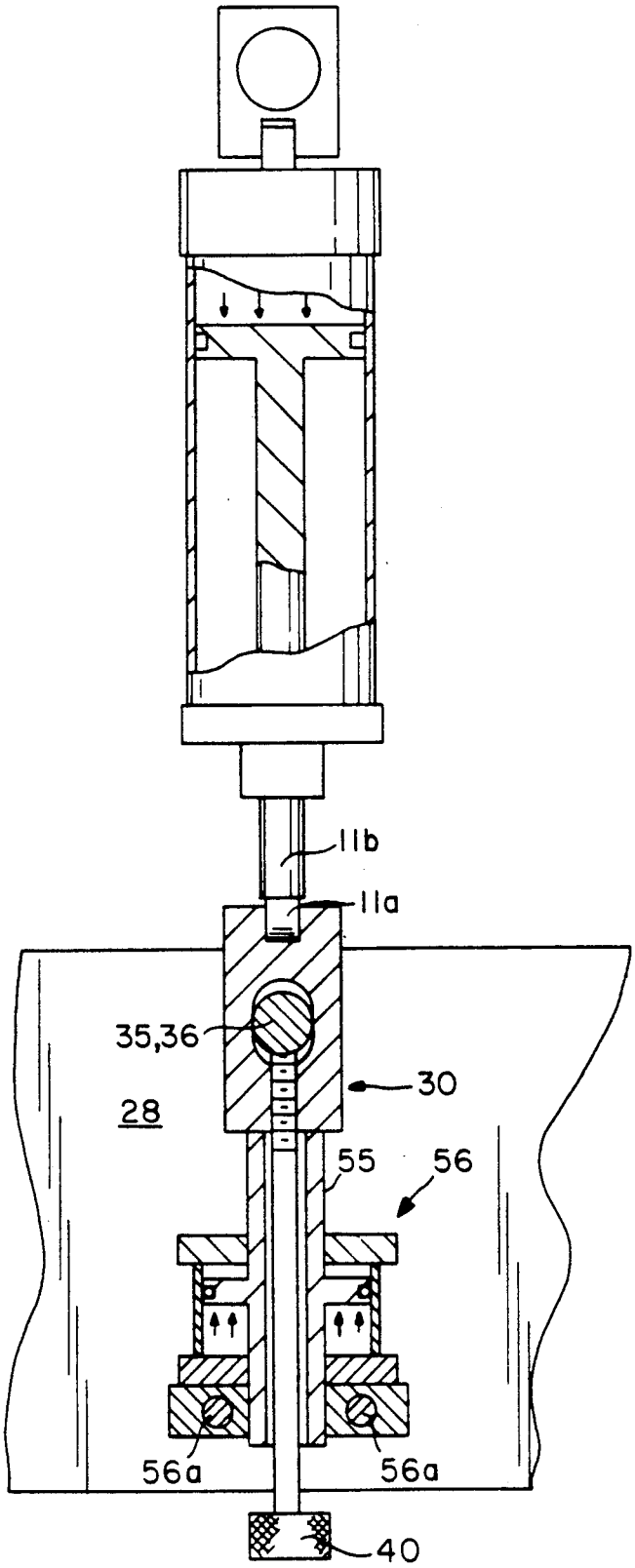
FIG. 5 is a crossectional view of another embodiment of the connection between a driver and a filling unit according to the principles of the present invention at the end of a suction or intake stroke.

In some applications, bearing 33 and stop 45 may be deleted wherein the bearing section 36 of screw 35 would ride in slot 32 directly and contact adjusting screw 40 acting as a stop. Similarly, lock nut 41 may also be deleted. These two modifications are shown in FIG. 5.

The fine adjusting screw 40 includes a smooth shaft portion 40*a* which is received in the smooth bore 58 of actuator bar 59 and extends therethrough to the swivel member 31.

It should be noted that the fine adjusting screw 40, by extending through and substantially below the actuator bar 59, provides access external of the area of the moving parts and therefore allows adjustment during operation of the filling machine.

As in the previous U.S. Pat. Nos. 4,212,416 and 4,227,627 the lower swivel assembly 30 provides individual fine tuning for each of the filling units by changing the lost motion and thereby the effective length of the stroke of the piston in the cylinder of the filling unit without changing the volume of the cylinder of the filling unit.

A swivel pin 42 held in place by a cotter pin 43 pivotally connects the lower end 11*b* of the piston rod 11*a* in the notch 44 provided in the upper portion of the swivel member 31.

The overall adjustment for the quantity dispensed by all filling units is at first adjusted in a conventional manner by the volume control providing on an adjustable stroke, lockable crank (not shown). Thereafter, if necessary, a fine adjustment is made individually for each filling unit 11 by more or less screwing the fine adjustment screw 40 and stop 45 into the elongated slot 32. To decrease the volume dispensed by a given filling unit, the operator merely loosens the lock nut 41, then unscrews the fine adjusting screw 40 so as to reduce the projection of stop 45 into the elongated slot 32, as a result of which the bearing member 33 is permitted to slide back and forth a greater distance in the slot 32. Then the lost motion between the movement of the bearing member 33 as imparted thereto by the common drive bar 28, and the swivel member 31 is increased the more the fine adjusting screw 40 is unscrewed out of the slot 32. Inversely, by screwing the fine adjusting screw 40 and stop 45 to a greater extend into the slot 32, the amount of lost motion between the bearing member 33 and the swivel member 31 during each cycle of the drive bar 28 is decreased, thereby increasing the effective length of the piston stroke.

As can be readily seen from the drawing, the fine adjustment can be made from a maximum piston stroke in which the fine adjusting screw 40 and stop 45 is screwed into the slot 32 to such an extent as to substantially eliminate any sliding movement of the bearing member 33 in the slot 32 relative to the swivel member 31, to a minimum piston stroke which occurs when the fine adjusting screw 40 and stop 45 is screwed out so far that maximum lost motion as represented by the length of the elongated slot 32 minus the stop 45 is permitted between the bearing member 33 and the swivel member 31. The minimum piston stroke and maximum lost motion is illustrated in FIGS. 2 and 3.

A counteracting mechanism is provided to counteract the forces produced by the piston of the filing unit on the lost motion mechanism during the suction or intake stroke to assure that the lost motion mechanism operates with lost motion. The counteracting mechanism includes a piston/cylinder combination 56 mounted to the drive bar 28 by mounting block 57 and is stationery relative thereto. A piston rod 55 of piston cylinder 56 is connected to actuator bar 59 by a split yoke 54 and a swivel pin 53 extending through the yoke 54 and an aperture 52 of the actuator bar 59. The swivel pin 53 is held in place by, for example, a cotter pin **53*a*. A fastener 50 extends through the elongated slot 51 in the actuator bar 59 and is threadably received in threaded aperture 28*a* of the common drive bar 28. The fastener 50 acts as a guide for the movement of the actuator bar 59 relative to the drive bar 28**.

Figure 3:
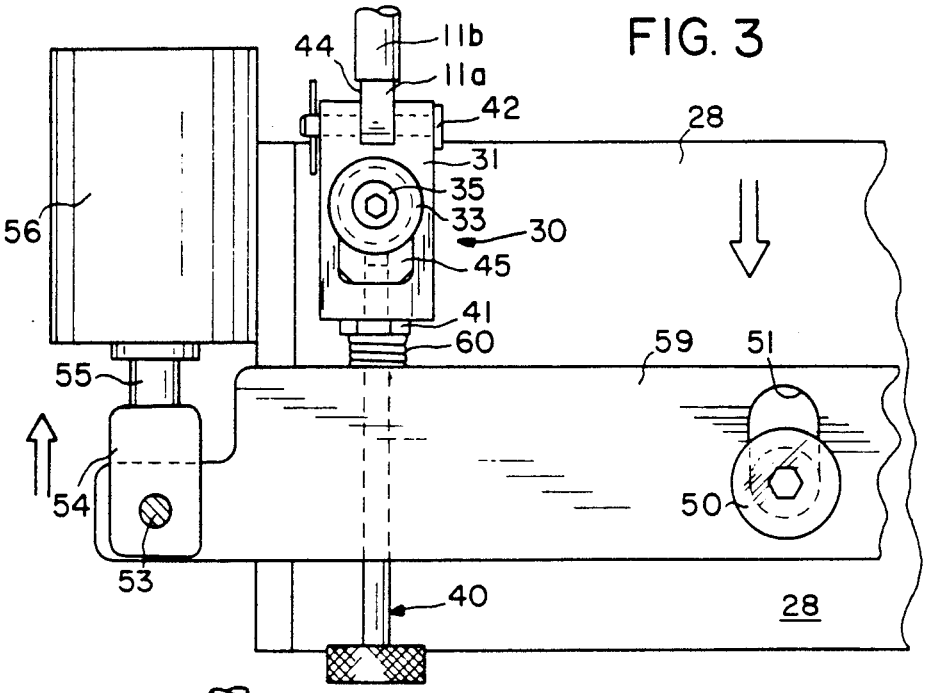
FIG. 3 is a view of the connection between a driver and a filling unit according to the principles of the present invention at the end of a suction or intake stroke.
Figure 4:
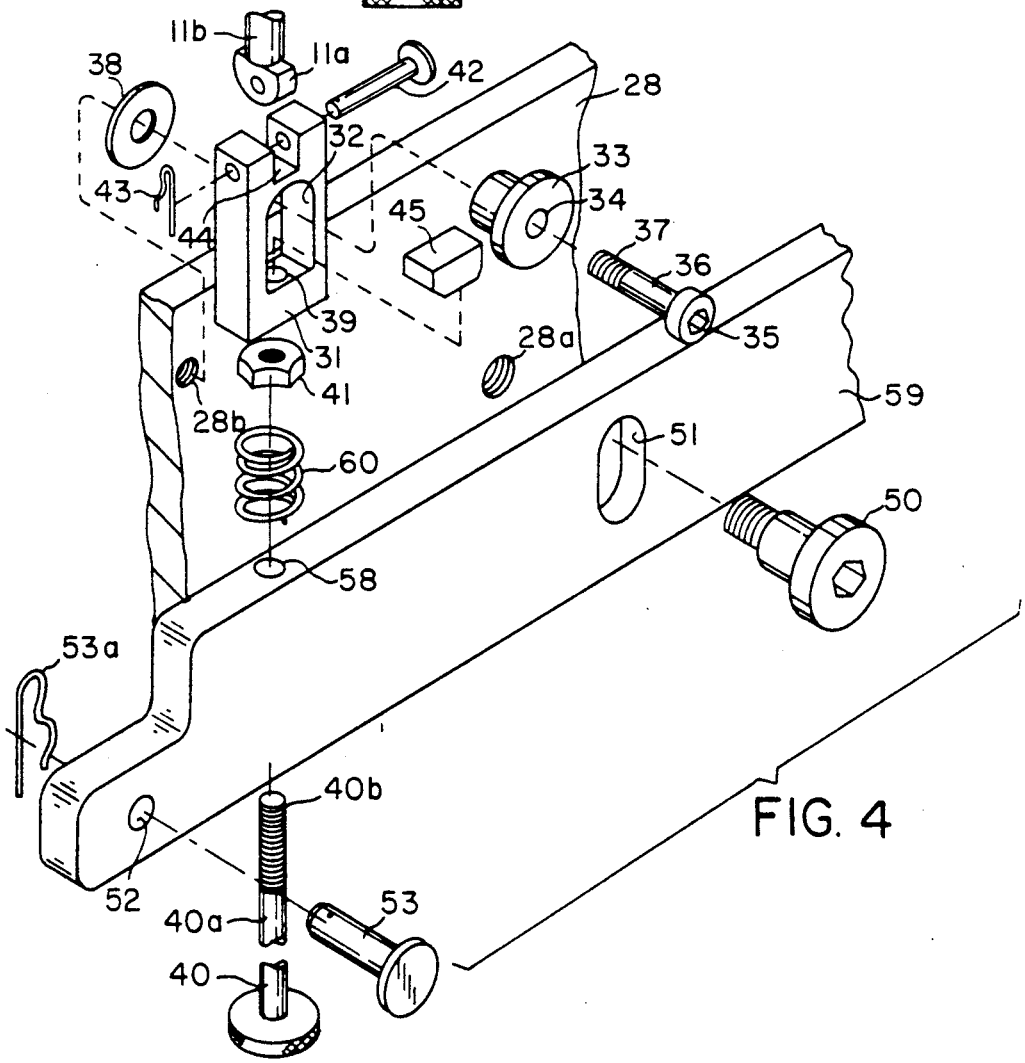
FIG. 4 is an exploded view of the connection between the driver and the filling unit according to the principles of the present invention.

The actuator bar 59 interacts with the swivel member 31 of the lost motion mechanism 30 by a biasing element 60 as illustrated in FIGS. 2–4. As noted with respect to FIG. 5, the piston rod 55 may connect the piston/cylinder 56 directly to swivel member 31. The biasing element 60, illustrated as a compression spring, is coiled around the shaft portion **40*a* and is secured between the actuator bar 59 and the swivel member 31. As will be discussed more fully below, the biasing element 60 forces the swivel member 31 so as to be effective during the suction or intake stroke of FIG. 3 to counteract forces produced by the piston of the filling unit 11 by positive pressure on the product side of the piston or by a vacuum on the underside of the piston to assure that the bearing 33 rests against the stop 45** during the intake stroke.

During the discharge stroke illustrated in FIG. 2, the piston rod 55 is extended to unload the spring 60. Thus, the biasing element 60 is inoperative during the discharge stroke of FIG. 2 wherein the bearing surface 33 rests against the opposed wall of the swivel member 31. During the intake or suction stroke illustrated in FIG. 3, the piston rod 55 is retracted to load the spring 60. The force of the loaded spring member 60 is selected to preload the swivel member 31 with a force in excess of the force produced during the intake or suction stroke so as to assure that the lost motion of the lower swivel assembly 30 is assured.

The operation of the filling machine 10 begins, as in FIG. 2, with the filling unit at the end of its discharge stroke. Piston rod 55 of the piston/cylinder 56 was extended during the discharge stroke, causing the actuator bar 59 to engage the fastener 50 in the top of slot 51 and to reduce the force or loading on spring 60. The force exerted by the material being fed from the filling unit maintains the bearing member 33 engaged on the filing unit end of the slot 32 as the common drive bar 28 moves up in the figures during the discharge stroke.

The suction or intake stroke begins with the common drive bar 28 moving down in the figures. After the intake stroke begins, piston rod 55 of the driver 56 begins to retract causing the actuator bar 59 to move up relative to drive bar 28 until fastener 50 engages the bottom of slot 51, thereby comprising the spring 60. The bearing member 33 will now pass through the lost motion corresponding to its travel from its engagement with the one end of the slot 32 into engagement with the stop 45. The force exerted by spring 60 resists or counteracts any force from the filling unit to maintain the swivel 31 initially stationery with respect to the filling unit and allowing the common drive bar 28 and bearing surface 33 to move relative to the swivel member 31. Once the bearing member 33 engages the stop 45, it drives the swivel 31 and the piston rod 11 to the end of its suction or intake stroke as illustrated in FIG. 3. The amount of lost motion determines the volume adjustment of the piston.

After the beginning of the discharge stroke, the piston 55 is extended by the piston/cylinder 56 causing the actuator bar 59 to move down relative to drive bar 28 until the fastener 50 engages the top of slot 51. This allows the bearing member 33 to disengage the stop 45 and travel through lost motion until it engages the opposed surface of slot 32 as the drive bar 28 moves up. The pressure of the liquid being fed from the filing unit is greater than the force exerted by spring 60 which is ineffective during the discharge stroke thereby allowing lost motion to occur during the discharge stroke while assuring that lost motion occurs during the intake stroke.

Thus it can be seen that the biasing spring 60 is operable during the intake or suction stroke to bias the swivel 31 against any forces produced by pressure differentials across the feed piston during the intake stroke from the filling unit produced by positive pressure on the upper or product side of the piston or vacuum on the underside of the piston to maintain the swivel 31 fixed to assure lost motion travel by the bearing 33 and the drive assembly 28. The bias spring 60 is insufficient to effect lost motion during the discharge stroke. Thus the lost motion device of FIG. 2 through 4 may be used with any filling unit.

In certain situations, it may be preferred to have a counter acting actuator per filing unit. As illustrated in FIG. 5, the piston/cylinder 56 is mounted to the drive bar 28 by fasteners through holes **56*a*. The piston rod 55, when extending during the intake stroke, interacts directly with the swivel 31 to drive the screw 35 to engage the end of adjusting screw 40. This produces the lost motion during the intake stroke. When the piston rod is retracted, during the discharge stroke, it disengages from the swivel 31 allowing it to travel down until the screw 35 engages the filing machine end of slot 32** under the force of the discharging material. Thus, the counteracting mechanism of FIG. 5 is operative during the intake stroke to assure lost motion of the drive bar relative to the filing unit and inoperative during the discharge stroke. Each of the filling units would include one of the counteracting mechanism of FIG. 5.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A volume adjusting mechanism for a container filling machine having at least one filling unit which includes a pump cylinder and piston movable in said cylinder to provide intake and discharge strokes, and having drive means for providing a reciprocal driving motion, said mechanism comprising:

first means for connecting said mechanism to said filling unit;

second means adjustable with respect to said first means for defining the amount of lost motion between said drive means and said filling unit to determine the adjustable volume of said filling unit, third means positioned between said first and second means for connecting said drive means to said mechanism;

counteracting means for counteracting forces between said drive means and said filling unit to assure that said mechanism operates with lost motion during said uptake stroke; and said counteracting means including actuator means operable totally independent of said drive means and having a first position for maintaining said mechanism at a first lost motion position during said intake stroke and a second position permitting said mechanism to assume a second lost motion position during said discharge stroke.

2. A volume adjusting mechanism according to claim 1, wherein said counteracting means is between said first means and said drive means.

3. A volume adjusting mechanism according to claim 1, wherein said counteracting means includes a spring between said first means and said drive means, and said actuator means uniformly loading said spring during said intake stroke and disables said spring during said discharge stroke.

4. A volume adjusting mechanism according to claim 1, wherein said first means includes an elongated slot, said second means varies the length of said elongated slot and said third means slides within said elongated slot.

5. A volume adjusting mechanism according to claim 1, wherein second means includes a shaft extending from said first means to said drive means and said counteracting means is mounted around said shaft between said first means and said drive means.

6. A volume adjusting mechanism according to claim 5, wherein said shaft is threaded into said first means and is sufficiently long to extend through said drive means.

7. A filling machine for filling containers comprising:

at least one filling unit including a pump cylinder and a piston movable in said cylinder to provide intake and discharge strokes;

drive means for providing reciprocal driving motion;

adjustable lost motion means connected between said filling unit and said drive means for defining the amount of lost motion to determine the adjustable volume of said filling unit; and counteracting means for counteracting forces between said drive means and said filling unit to assure that said lost motion means operates with lost motion during said intake stroke; and said counteracting means including actuator means operable totally independent of said drive means and having a first position for maintaining said lost motion means at a first lost motion position during said intake stroke and a second position permitting said lost motion means to assume a second lost motion position during said discharge stroke.

8. A filling machine according to claim 7, wherein said counteracting means is between said lost motion means and said drive means.

9. A filling machine according to claim 7, wherein said lost motion means includes:

a first means having an elongated slot;

a second means adjustable relative to said first means for varying the length of said elongated slot;

third means for connecting one of said drive means or said filling unit to said lost motion means; and fourth means for connecting the other of said driving means or filling unit to said lost motion means.

10. A filling machine according to claim 9, wherein second means includes a shaft extending from said first means to said drive means and said counteracting means is mounted around said shaft between said first means and said drive means.

11. A filling machine according to claim 10, wherein said shaft is threaded into said first means and extends through said drive means.

12. A filling machine according to claim 9, wherein said third means is connected to said drive means and said fourth means is connected to said filling unit.

13. A filling machine according to claim 7, wherein said lost motion means includes a threaded shaft to adjust the amount of lost motion and said counteracting means is mounted around said shaft between said lost motion means and said drive means.

14. A filling machine according to claim 13, wherein said shaft extends through said drive means.

15. A filling machine according to claim 7, wherein said drive means provides linear reciprocal driving motion.

16. A filling machine according to claim 7, wherein said drive means provides eccentric reciprocal driving motion.

17. A filling machine according to claim 7 including a plurality of filling units connected to a common drive means by individual adjustable lost motion means and counteract of means.

18. A filling machine according to claim 7, wherein said counteracting means includes a spring between said lost motion means and said drive means, and said said actuator means uniformly loading said spring during said intake stroke and disables said spring during said discharge stroke.

* * * * *